US005897005A

United States Patent [19]

Bernens et al.

[11] Patent Number: 5,897,005

[45] Date of Patent: Apr. 27, 1999

[54] MERCHANDISING DISPLAY RACK

[75] Inventors: David Charles Bernens; William Birmingham, both of Cincinnati, Ohio

[73] Assignee: Futuro, Inc., Milford, Ohio

[21] Appl. No.: 08/641,906

[22] Filed: May 2, 1996

[51] Int. Cl.[6] ..... A47F 7/00

[52] U.S. Cl. ..... 211/189

[58] Field of Search ..... 211/189, 181, 211/62, 60.1, 133.1, 133.2, 191

[56] References Cited

U.S. PATENT DOCUMENTS

| | | | |
|---|---|---|---|
| 3,799,357 | 3/1974 | Govang | 211/59 |
| 3,971,477 | 7/1976 | Bruderly et al. | 211/189 |
| 4,508,231 | 4/1985 | Honickman | 211/199 |
| 4,775,054 | 10/1988 | Dixon | 211/57.1 |
| 5,012,997 | 5/1991 | Hutchison | 248/220.4 |
| 5,048,701 | 9/1991 | Simpson | 211/189 |
| 5,083,668 | 1/1992 | Bushey | 211/59.1 |
| 5,344,027 | 9/1994 | Kaplan | 211/1 |
| 5,443,167 | 8/1995 | Menaged | 211/87 |

*Primary Examiner*—Alvin Chin-Shue
*Assistant Examiner*—Sarah L. Purol
*Attorney, Agent, or Firm*—Frost & Jacobs

[57] ABSTRACT

A merchandising display rack is provided for displaying products in which the display rack is constructed of a freestanding framework. One or more of its sides includes a several of adjacently disposed partitioned bays or product display modules. Additionally, each of the product display modules includes one or more substantially horizontal product engaging rods disposed across its width. In a preferred embodiment of the invention, each module and each rod are at a different elevation from the elevations of each adjacent module and its corresponding rod. Alternatively, each module and each rod are positioned at substantially equivalent elevations. In an alternative embodiment of the present invention, a merchandising display fixture is provided comprising a framework that includes several adjacently disposed bays or product display modules having corresponding product engaging rods. Preferably, each module and each rod are at different elevations from the elevations of each adjacent module and its corresponding rod. Alternatively, each module and each rod may be positioned at substantially equivalent elevations.

22 Claims, 6 Drawing Sheets

MERCHANDISING DISPLAY RACK

TECHNICAL FIELD

The present invention relates generally to merchandising display equipment and is particularly directed to display racks of the type which are suited to display merchandise in retail stores. The invention is specifically disclosed as a merchandising display rack for compartmentalizing and displaying a variety of health care equipment including canes, crutches and walkers.

BACKGROUND OF THE INVENTION

The highly competitive nature of the self-service retail industry requires stores to display and offer for sale a wide variety of products in a visually pleasing and efficient manner. Merchandising display racks for storing products and promoting their sale are well known in the art. One frequently used type of display rack designed to increase the merchandising display capacity of a self-service retail store is a self-supporting or freestanding "point of sale" display. Commonly, this type of display unit is employed to showcase newer products and is often supplied to the retailer by the product manufacturer in order to effectively display the manufacturer's particular goods. A key advantage of this type of display unit is its capability of displaying product wherever sufficient retail floor space permits. Accordingly, such freestanding merchandising displays are readily capable of being positioned in hightraffic locations to allow for maximum visibility and the greatest exposure of the displayed products to potential customers.

Additionally, it is common in the art to use various pegboard display systems to exhibit retail products and other items. In this type of display system, one or more upright pegboard supports, or other similar display panels having a plurality of uniformly spaced holes, are used to provide a vertical mounting system. The panels generally have a front surface forming a background for the displayed products. The spaced holes are provided to support brackets, fixtures, and hangers of various configurations and sizes. Typically, these fixtures include one or more prongs configured to selectively engage corresponding mounting holes in the display panels, thus securely retaining the fixtures or brackets thereon so that they may support and display products.

One limitation present in various conventional merchandising display systems is their inability to effectively present information in conjunction with the displayed products. Information that is often made more useful by being place in close proximity to the displayed product includes pricing information, inventory control and reordering information, and product names and descriptions. For example, it is common in conventional commercial display devices containing walking canes to store a variety of different canes on one display device. Examples of such display racks include FUTUROO® Cane Department #390040 and FUTURO® Pegged Cane Display #390041.

Since conventional cane display racks are not compartmentalized, walking canes hung thereon tend to become intermixed over time as customers handle the canes, thus making it more difficult for later customers to readily identify and select appropriate products. Further, because the canes have no designated storage locations on conventional walking cane display racks, it has been impossible to provide signs that present information about each cane in such a way as to ensure that information is displayed in a convenient location in close proximity to the cane it describes.

SUMMARY OF THE INVENTION

Accordingly, it is a primary object of the present invention to provide a freestanding merchandising display rack that displays a variety of products in an attractive, organized, efficient, and highly visible manner.

It is another object of the present invention to provide a freestanding display rack that is capable of compartmentalizing identical products, such as walking canes, in order to facilitate inventory control and to ensure an orderly display of product while requiring minimal organizational maintenance by retail personnel.

It is a further object of the present invention to provide a freestanding display rack that maximizes sales by providing means for presenting information proximal to each displayed product, thereby providing a customer with key product information while simultaneously facilitating a means to accurately track product inventory.

It is yet another object of the present invention to provide a merchandising display rack for use with a panel display system, such as pegboard, that displays a variety of products in an attractive, organized, efficient, and highly visible manner.

It is still another object of the present invention to provide a merchandising display rack for use with a panel display system, such as pegboard, that is capable of compartmentalizing identical products, such as walking canes, in order to facilitate inventory control and to ensure an orderly display of product while requiring minimal organizational maintenance by retail personnel.

It is yet another object of the present invention to provide a merchandising display rack for use with a panel display system, such as pegboard, that maximizes sales by providing means for presenting information proximal to each displayed product, thereby providing a customer with key product information while simultaneously facilitating a means to accurately track product inventory.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved merchandising display rack is provided that includes a freestanding framework. One or more of the framework's sides includes several adjacently disposed partitioned bays or product display modules. Additionally, each of the product display modules includes one or more horizontal product engaging rods disposed across its width. In one preferred embodiment of the invention, each module and each rod are at a different elevation from the elevations of each adjacent module and its corresponding rod. Alternatively, in a second preferred embodiment, each module and each rod are positioned at substantially equivalent elevations.

In an alternative embodiment of the present invention, a merchandising display fixture is provided generally constructed as a framework. The fixture includes one or more prongs capable of being inserted into corresponding apertures in a merchandising display board, such as pegboard. Similar to the freestanding display embodiment, the fixture embodiment also includes a plurality of adjacently disposed partitioned bays or product display modules. Each product display module includes one or more horizontal product engaging rods disposed across its width. Preferably, each module and each rod are at different elevations from the elevations of each adjacent module and its corresponding rod. Alternatively, each module and each rod may be positioned at substantially equivalent elevations.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without department from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
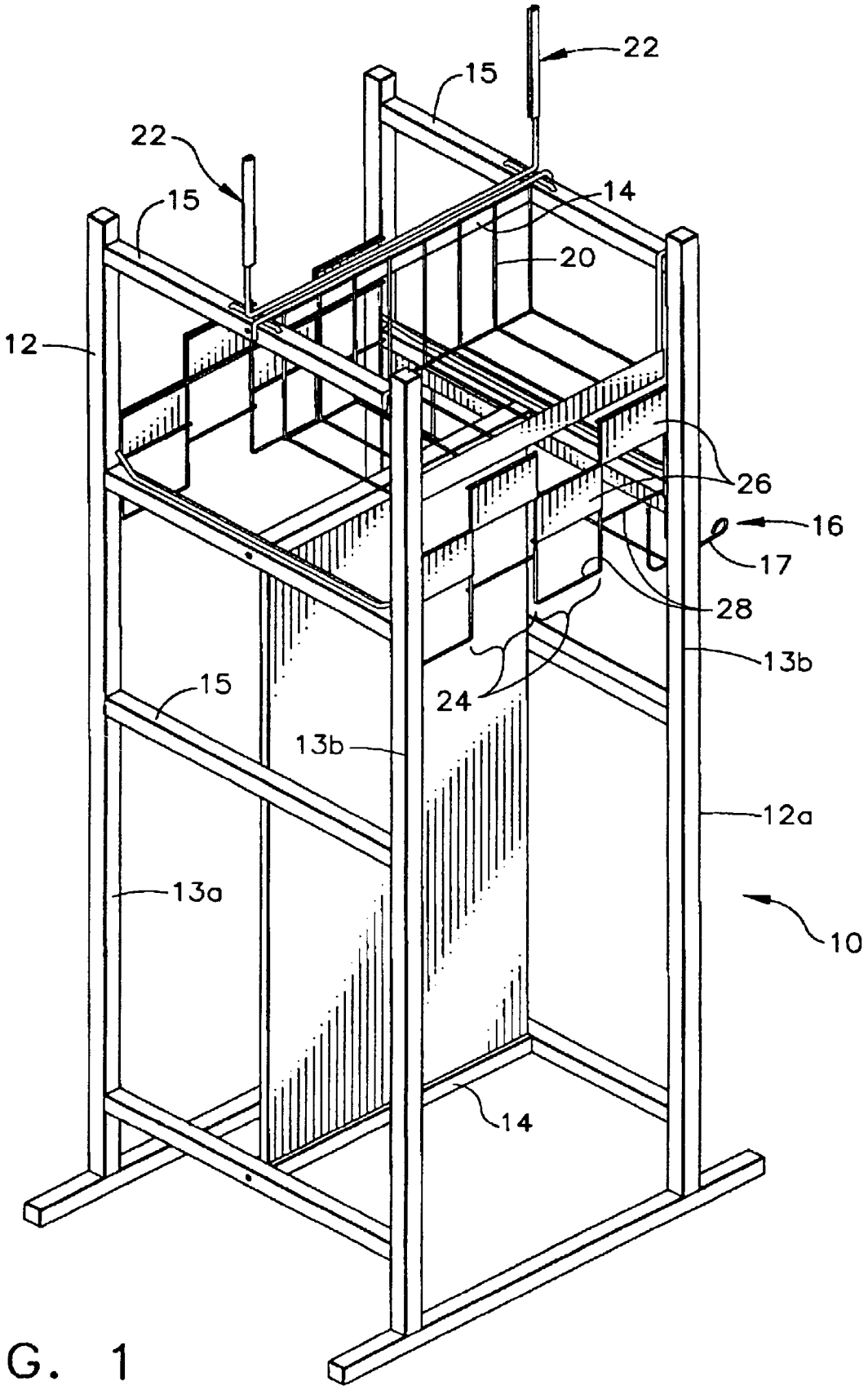
FIG. 1 is a perspective view of a freestanding merchandising display rack constructed according to the principles of the present invention having two sides that contain adjacently disposed product display modules in which every other module is of a substantially equivalent elevation and in which adjacent modules have different elevations.

Referring now to the drawings, FIG. 1 shows a freestanding merchandising display rack, generally designated by the numeral 10, which is constructed as a framework. Preferably, two of the sides of the display rack 10 generally include at least one end panel frame unit 12, comprising a pair of first and second spaced-apart and vertical members 13*a* and 13*b*. Members 13*a*, 13*b* are fixedly held in a substantially parallel relationship by at least one laterally disposed end panel side support 15. Additionally, each of the sides comprising at least one end panel frame unit 12 is fixedly connected to and spaced apart from another end panel frame unit 12*a* in a substantially parallel relationship by means of at least one transversely disposed cross support 14. It will be understood that the configuration of the framework of display rack 10 results in a structure that is self-supporting and advantageously capable of being placed in a retail store wherever there is sufficient floor space. Accordingly, display rack 10 may be placed in areas of a store where there is the heaviest customer traffic, thereby providing for increased product visibility.

Figure 2:
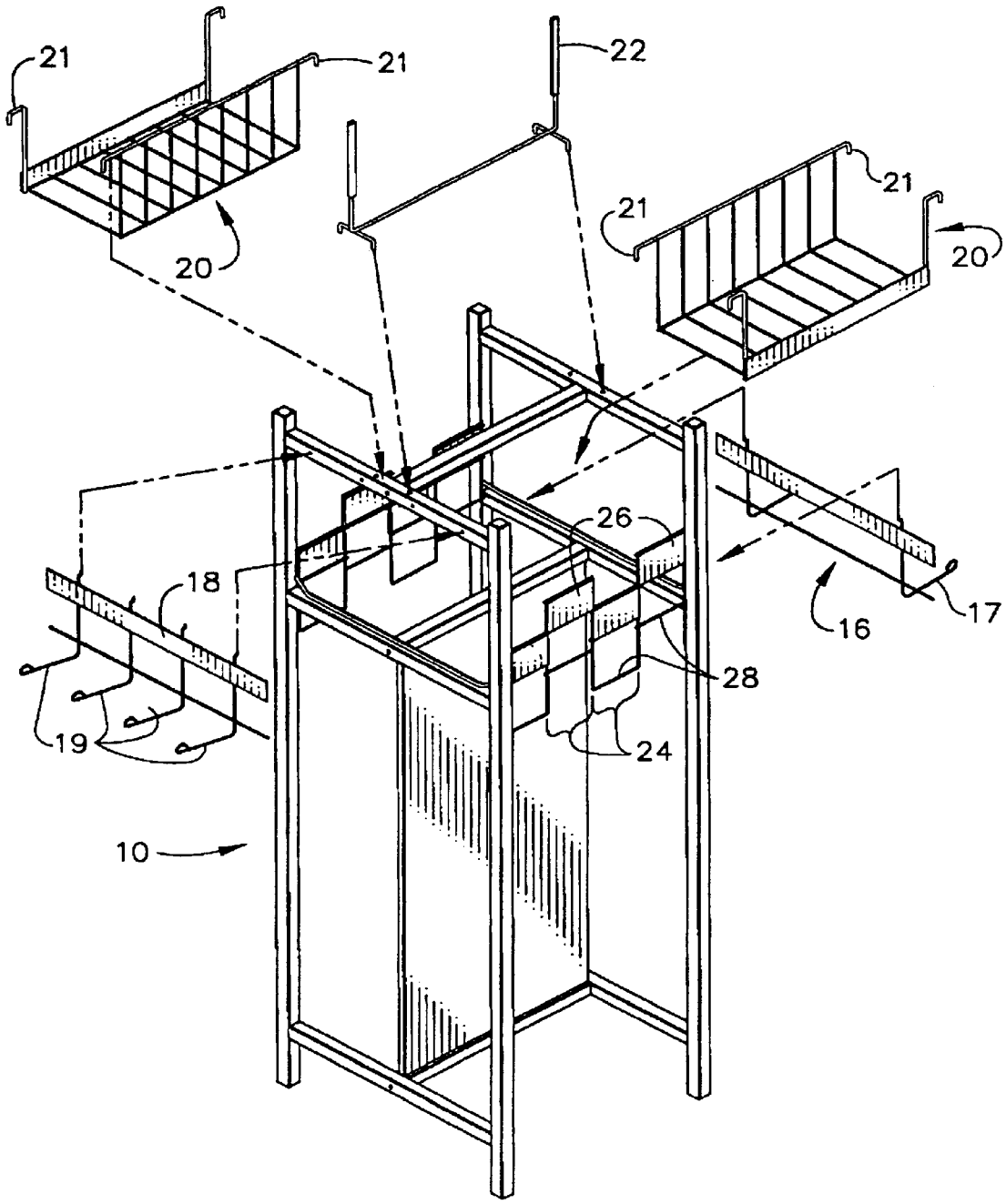
FIG. 2 is an exploded perspective view of the freestanding display rack of FIG. 1.

As best shown in FIGS. 1 and 2, display rack 10 preferably includes various product display attachments. For example, display rack 10 may include one or more shelves 20. As shown in FIG. 2, shelves 20 may be formed from a relatively coarse wire mesh having at least one hook 21 capable of being placed in releasable engagement with at least one of the cross supports 14 or side supports 15. As should be appreciated, shelves 20 are capable of supporting and displaying a variety of products.

Figure 3A:
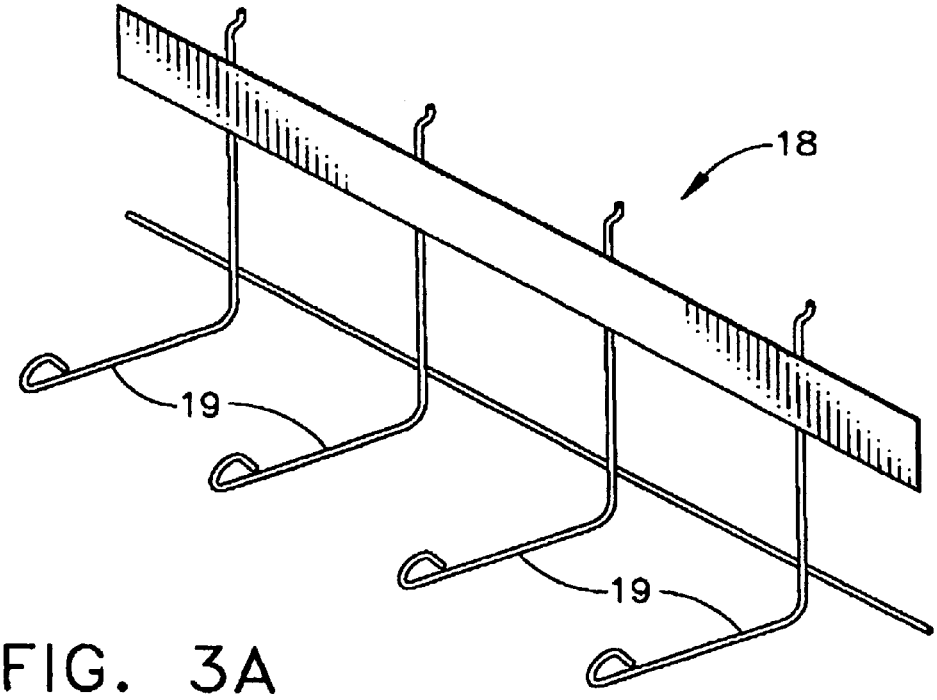
FIG. 3A is a perspective view of the crutch hanging unit that attaches to the freestanding display rack of FIG. 1.

Additionally, as shown in FIGS. 1 and 2, display rack 10 may include at least one "hanging unit" 18 that is releasably attached to at least one of the said cross supports 14 or side supports 15. As best shown in FIG. 3A, the crutch hanging unit 18 includes a plurality of spaced arms 19 capable of storing and supporting a variety of products having a relatively wider top portion and a relatively narrower lower portion and that further have a portion wider than the distance between corresponding arms 19. The crutch hanging unit 18, for example, is ideally suited for storing a number of adjacently stacked crutches. To store and display a crutch or similar object on hanging unit 18, a relatively narrow portion of the crutch is first placed in an opening between selected arms 19 of the crutch hanging unit 18. Next, the crutch is lowered until both sides of said crutch are supportedly engaged by at least two of said arms 19 of said crutch hanging unit 18.

Figure 3B:
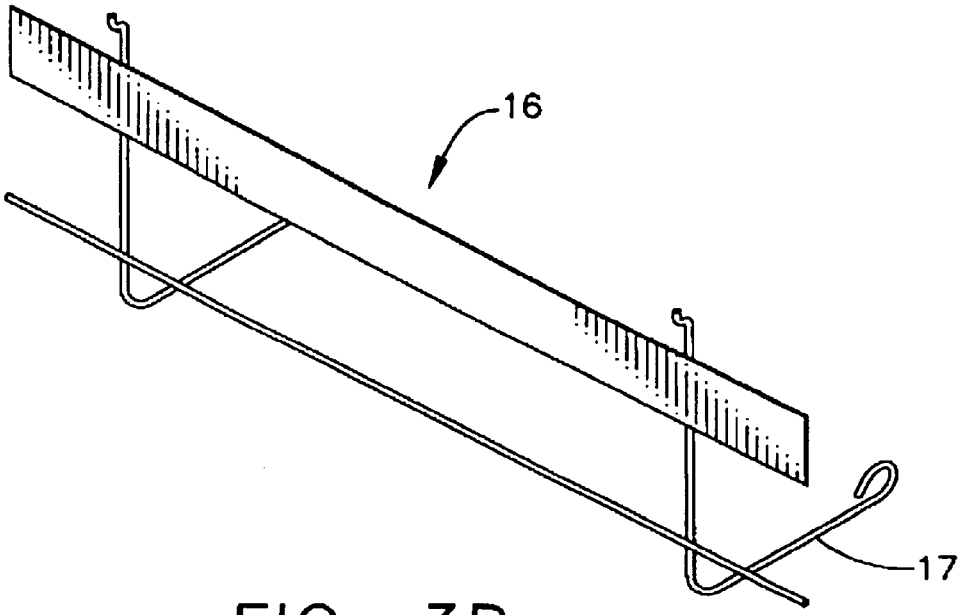
FIG. 3B is a perspective view of the walker hanging unit that attaches to the freestanding display rack of FIG. 1.

The display rack 10 may also include at least one foldable walker hanging unit 16 attached to at least one of said cross supports 14 or said side supports 15. As best shown in FIG. 3B, the walker hanging unit 16 includes at least one outwardly extending projection 17 ideally suited for supportedly engaging relatively large products (such as walkers).

Display rack 10 preferably also includes a header sign holder unit 22 that is releasably attached to at least one of the cross supports 14 or said side supports 15. It will be understood that sign holder unit 22 is advantageously constructed to hold a relatively large sign that is capable of providing general information about all of the products displayed on said display rack 10.

According to an important aspect of the invention, merchandising display rack 10 includes at least one side having a plurality of adjacently disposed and partitioned bays or product display modules 24. Each module 24 includes at least one substantially horizontal product engaging rod 28 disposed across the module's a width. In the illustrated embodiment of FIG. 2, each product display module 24 and each rod 28 is disposed at an elevation different from the elevations of each adjacent module 24 and its corresponding rod 28. Preferably, every other (i.e., alternating) product engaging rods 28 are of substantially equivalent elevations. The product engaging modules are ideally suited for displaying products such as canes, which may readily be hung and displayed thereon. Further, the alternating elevations of product display modules 24 and rods 28 of the product display modules clearly compartmentalizes and separates different products, thereby allowing a consumer to readily observe available product choices and to make the appropriate selections.

Additionally, the display rack 10 includes a plurality of planar indicia 26, which preferably are substantially co-planar. One each of these planar indicia 26 is positioned proximal and at a greater elevation to each one of the rods 28 of the product display modules 24. In the illustrated embodiment of FIG. 2, each indicia 26 is at an elevation different from the elevation of each adjacent indicia. Preferably, every other, or alternating indicia 26 are of substantially equivalent elevations. It will be understood that each one of the indicia 26 advantageously is capable of providing easily referenced product information, inventory control information, and any other information potentially helpful to either a consumer or a retailer.

Figure 5:
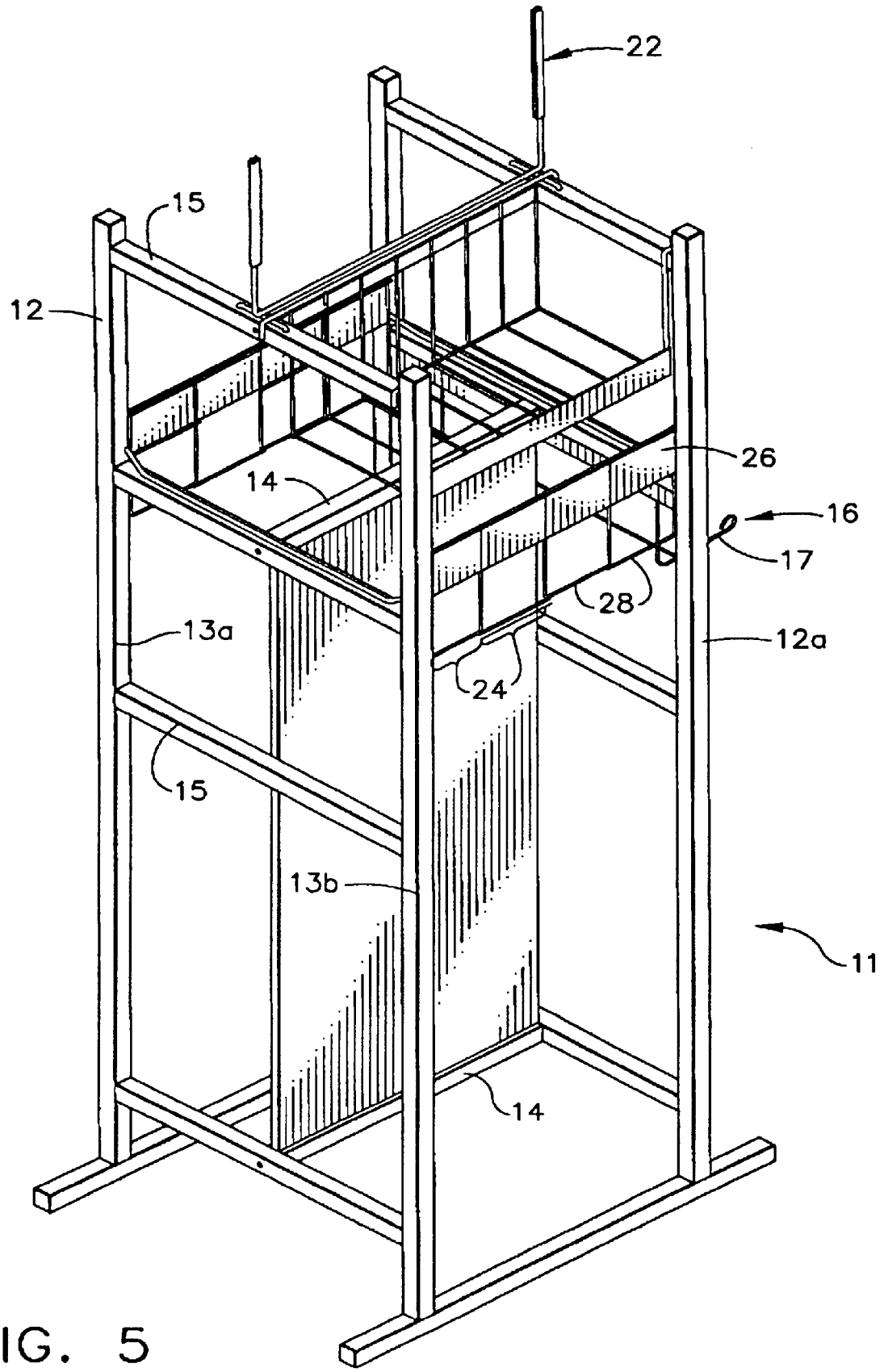
FIG. 5 is a perspective view of an alternative embodiment of the freestanding merchandising display rack constructed according to the principles of the present invention having two sides that contain adjacent product display modules of substantially similar elevations.

In an alternative embodiment display rack, generally designated by the index numeral 11, in FIG. 5, each of the planar indicia 26 may be located at substantially the same elevation. Similarly, in this alternative embodiment, each product display module 24 and each rod 28 are at elevations substantially equivalent to the elevation of each adjacent module 24 and rod 28. Alternative embodiment of display rack 11 allows for a retailer to display products, such as canes, in a more streamlined configuration while still advantageously allowing for the displayed product to be compartmentalized.

Figure 4:
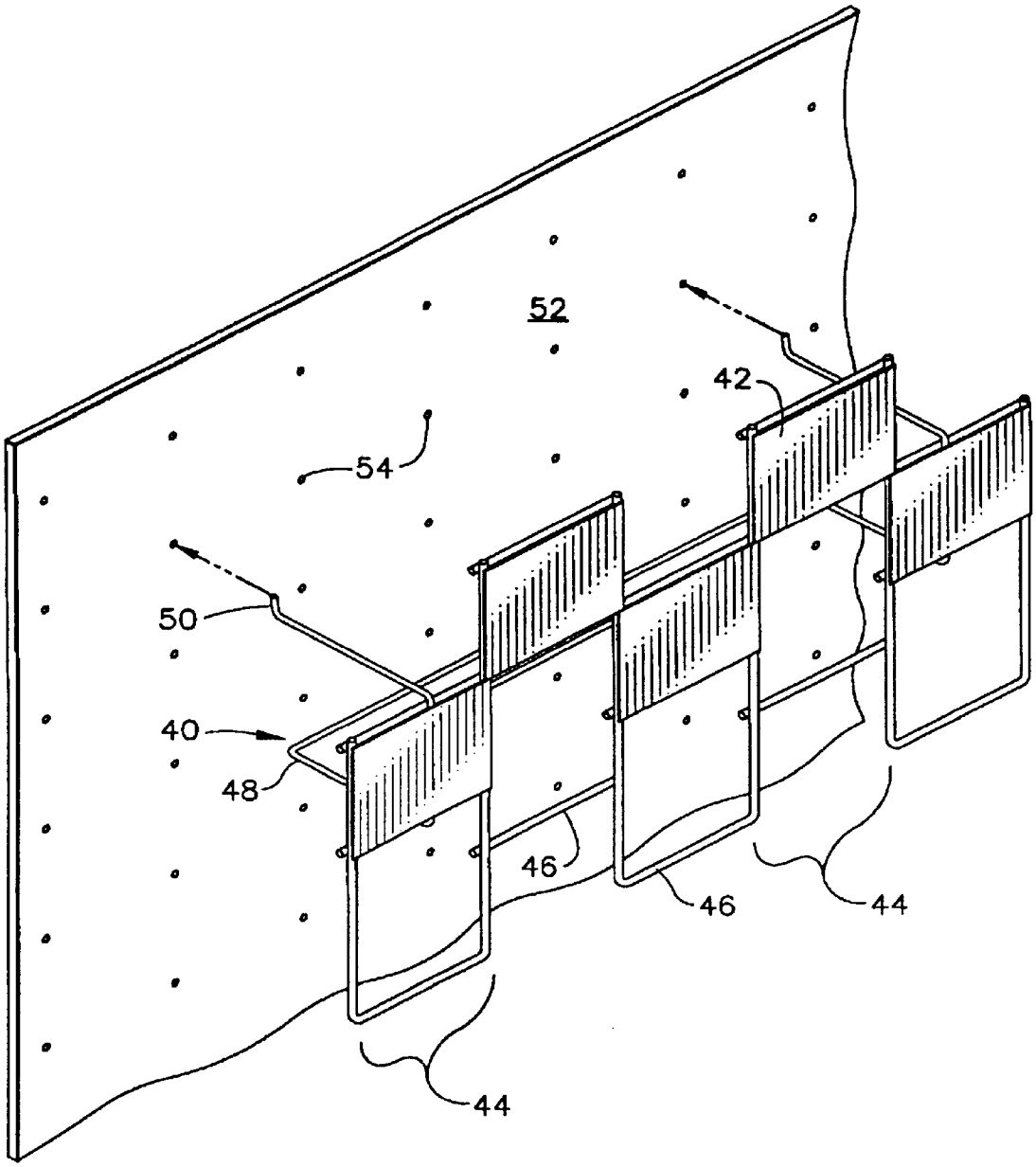
FIG. 4 is an exploded perspective view of a merchandising display fixture constructed according to the principles of the present invention in which every other module is of a substantially equivalent elevation and in which adjacent modules have different elevations.

As best shown in FIG. 4, an alternative embodiment of the present invention, a merchandising display fixture for use with pegboard or other similar retail display panel, is depicted, generally indicated by the index numeral 40. Fixture 40 includes one or more prongs 50 that are capable of being inserted into corresponding apertures or holes 54 in a length of pegboard 52 or other similar merchandising display board. Specifically, said prongs 50 ideally are generally hook-shaped so that when prongs 50 are inserted in corresponding apertures 54, fixture 40 may be rotated downwardly, thereby securing a vertical length of each prong 50 on the reverse side of pegboard 52. Additionally, fixture 40 includes a support bracket 48 that, together with the prongs 50, releasably holds the display fixture 40 on a selected portion of pegboard 52.

Similar to the freestanding display rack 10, display fixture 40 includes a plurality of adjacently disposed partitioned bays or product display modules 44. In order to engage and display products, each module 44 includes at least one substantially horizontal product engaging rod 46 disposed across the width of the module. In the preferred embodiment, each product display module 44 and each rod 46 is disposed at an elevation different from the elevations of each adjacent module 44 and its corresponding rod 46. Preferably, every other (i.e., alternating) product engaging rods 46 are of substantially equivalent elevations. The product engaging modules 44 are ideally suited for displaying products such as canes, which may readily be hung and displayed thereon. Further, the varying elevations of product display modules 44 and rods 46 compartmentalizes and separates different products thereby allowing a consumer to readily observe available product choices and to make the appropriate selections.

The display fixture 40 includes a plurality of planar indicia 42 that are similar to the indicia 26 of display rack 10, and preferably are substantially co-planar. Each one of the plurality of planar indicia 42 is positioned proximal and at a greater elevation to each one of rods 46 of product display modules 44. In the illustrated embodiment of FIG. 4, each indicia 42 is at an elevation different from the elevation of each adjacent indicia. Preferably, alternating indicia 42 are of substantially equivalent elevations. Each of the indicia 42 advantageously is capable of providing easily referenced product information, inventory control information, and any other information potentially helpful to either a consumer or a retailer.

Figure 6:
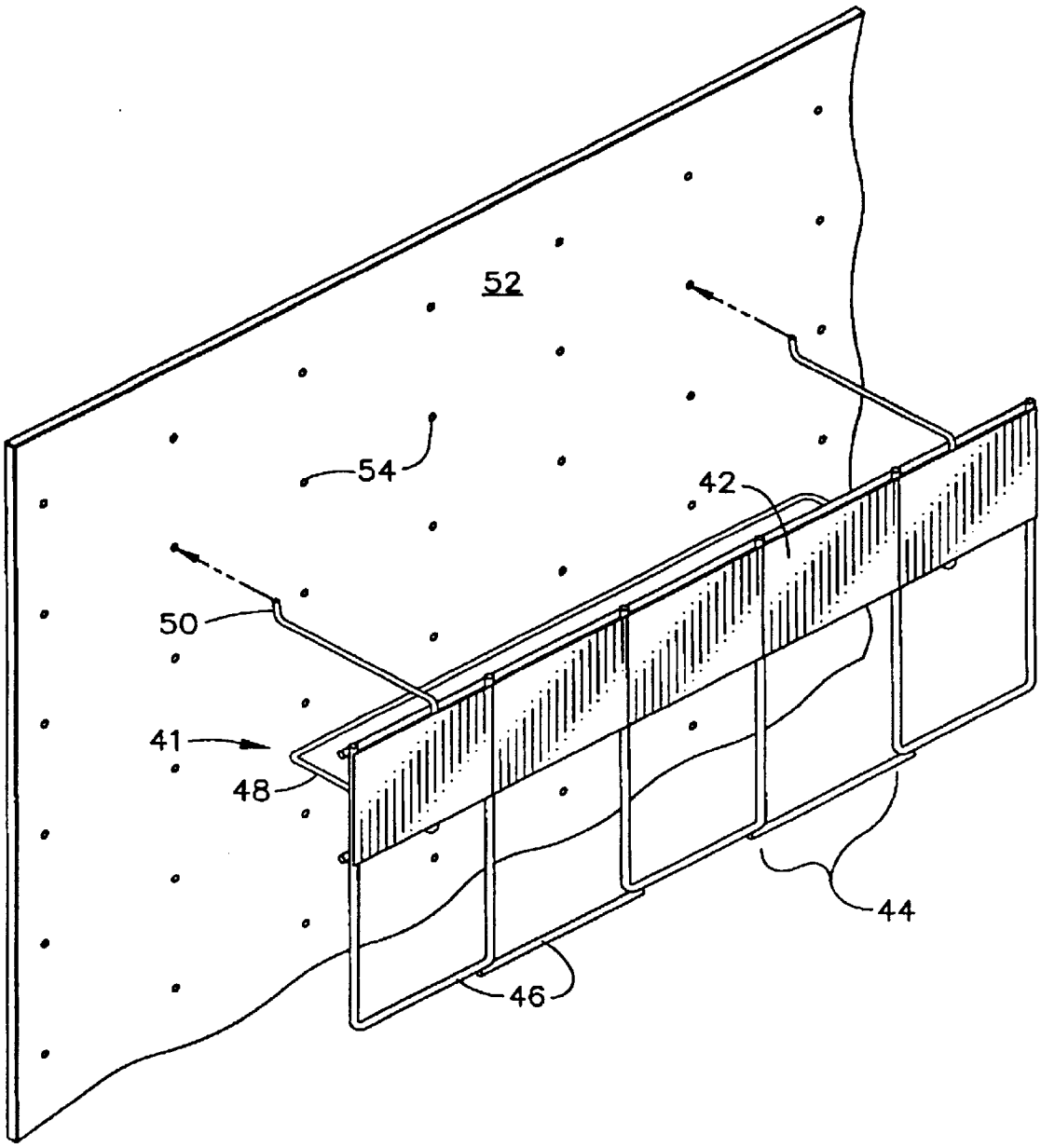
FIG. 6 is an exploded perspective view of an alternative embodiment of the merchandising display fixture constructed according to the principles of the present invention having adjacent product display modules of substantially equivalent elevations.

An alternative embodiment of display fixture 40 may be configured so that each of the planar indicia 42 are substantially at the same elevation, as viewed in FIG. 6 and generally indicated by the index numeral 41. Similarly, in this alternative embodiment 41, each product display module 44 and each rod 46 are at elevations substantially equivalent to the elevation of each adjacent module 44 and module 46. Display fixture 41 also allows for a retailer to display products, such as canes, in a more streamlined configuration on a pegboard panel while still advantageously allowing for the displayed product to be compartmentalized.

In summary, numerous benefits have been described which may result from employing the concepts of the invention. The merchandising display racks 10 and 11, or display fixtures 40 and 41 are each capable of displaying a variety of products in an attractive, efficient, and highly visible manner. The present invention is advantageously capable of compartmentalizing identical products, such as walking canes, in order to facilitate inventory control and to ensure an orderly display of product while requiring minimal organizational maintenance by retail personnel. Additionally, the merchandising display racks 10 and 11 and display fixtures 40 and 41 advantageously are capable of presenting consumers and retailers with convenient product information in close proximity to the displayed product.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended thereto.

We Claim:

1. A display rack, comprising:

(a) a framework having a plurality of sides, said framework being configured so as to be freestanding;

(b) at least one of said sides comprising a plurality of adjacently disposed partitioned product display modules, each of said product display modules including at least one substantially horizontal product engaging rod disposed across a width of each said product display module, each said product display module and its corresponding rod being at an elevation different from the elevations of an adjacent of said product display modules and their corresponding rods, all of said rods being substantially coplanar, each said product engaging rod further being disposed substantially parallel with a corresponding product display module.

2. The display rack according to claim 1, wherein said framework comprises at least one transversely disposed cross support, two of said sides of said framework each comprising an end panel frame unit, each said end panel frame unit comprising first and second vertically disposed members, said vertically disposed members being fixedly held in a substantially parallel relationship by at least one laterally disposed end panel side support, and each of said sides comprising an end panel frame unit further being fixedly connected in a substantially parallel relationship by said at least one cross support.

3. The display rack according to claim 1, further comprising a plurality of planar indicia, one of said indicia being positioned proximal and at a greater elevation to each one of said rods of said product display modules, each of said indicia being at an elevation different from the elevation of an adjacent of said indicia, all of said indicia being substantially coplanar.

4. The display rack according to claim 3, wherein alternating indicia are of substantially equivalent elevations.

5. The display rack according to claim 1, wherein alternating product engaging rods are of substantially equivalent elevations.

6. The display rack according to claim 1, further comprising at least one shelf that is releasably attached to at least one of said cross supports and said side supports.

7. The display rack according to claim 1, further comprising at least one crutch hanging unit that is releasably attached to at least one of said cross supports or said side supports, said crutch hanging unit including a plurality of outwardly extending arms.

8. The display rack according to claim 1, further comprising at least one walker hanging unit that is releasably attached to at least one of said cross supports or said side supports, said walker hanging unit comprising at least one outwardly extending projection.

9. The display rack according to claim 1, further comprising at least one header sign holder unit that is releasably attached to keep one of said cross supports and said side supports.

10. A display rack, comprising:

(a) a framework having a plurality of sides, said framework being configured so as to be freestanding;

(b) at least one of said sides comprising a plurality of adjacently disposed partitioned product display modules, each of said product display modules including at least one substantially horizontal product engaging rod disposed across a width of each said product display module, each said product display module and its corresponding rod being at an elevation substantially equivalent to the elevation of an adjacent of said product display modules and their corresponding rods, all of said rods being substantially coplanar, each said product enagaging rod further being disposed substantially parallel with a corresponding product display module.

11. The display rack according to claim 10, wherein said framework comprises at least one transversely disposed cross support, two of said sides of said framework each comprising an end panel frame unit, each said end panel frame unit comprising first and second vertically disposed members, said vertically disposed members being fixedly held in a substantially parallel relationship by at least one laterally disposed end panel side support, and each of said sides comprising an end panel frame unit further being fixedly connected in a substantially parallel relationship by said at least one cross support.

12. The display rack according to claim 10, further comprising a plurality of planar indicia, one of said indicia being positioned proximal and at a greater elevation to each one of said rods of said product display modules, each of said indicia being at an elevation substantially equivalent to the elevation of an adjacent of said indicia, all of said indicia being substantially coplanar.

13. The display rack according to claim 10, further comprising at least one shelf that is releasably attached to at least one of said cross supports and said side supports.

14. The display rack according to claim 10, further comprising at least one crutch hanging unit that is releasably attached to at least one of said cross supports or said side supports, said crutch hanging unit including a plurality of outwardly extending arms.

15. The display rack according to claim 10, further comprising at least one walker hanging unit that is releasably attached to at least one of said cross supports or said side supports, said walker hanging unit comprising at least one outwardly extending projection.

16. The display rack according to claim 10, further comprising at least one header sign holder unit that is releasably attached to at least one of said cross supports and said side supports.

17. A display fixture configured to mount against a merchandising display panel, said display fixture comprising: a framework comprising a plurality of substantially hook-shaped prongs, said prongs engaging with and being disengageably supported by corresponding apertures in a merchandising display board; said framework further including a support bracket that, together with said prongs, releasably holds said display fixture against a portion of said merchandising display board; and said framework additionally comprising a plurality of adjacently disposed partitioned product display modules, each of said product display modules including at least one substantially horizontal product engaging rod disposed across a width of each said product display module, each said product display module and its corresponding rod being at an elevation different from the elevation of an adjacent of said product display modules and their corresponding rods, all of said rods being substantially coplanar, each said product engaging rod further being disposed substantially parallel with a corresponding product display module.

18. The display fixture according to claim 17, further comprising a plurality of planar indicia, one of said indicia being positioned proximal and at a greater elevation to each one of said rods of said product display modules, each of said indicia being at an elevation different from the elevation of an adjacent of said indicia, all of said indicia being substantially coplanar.

19. The display fixture according to claim 18, wherein alternating indicia are of substantially equivalent elevations.

20. The display fixture according to claim 17, wherein alternating product engaging rods are of substantially equivalent elevations.

21. A display fixture configured to mount against a merchandising display panel, said display fixture comprising: a framework comprising a plurality of substantially hook-shaped prongs, said prongs engaging with and being disengageably supported by corresponding apertures in a merchandising display board; said framework further including a support bracket that, together with said prongs, releasably holds said display fixture against a portion of said merchandising display board; and said framework additionally comprising a plurality of adjacently disposed partitioned product display modules, each of said product display modules including at least one substantially horizontal product engaging rod disposed across a width of each said product display module, each said product display module and its corresponding rod being at an elevation substantially equivalent to the elevation of an adjacent of said product display modules and their corresponding rods, all of said rods being substantially coplanar, each said product engaging rod further being disposed substantially parallel with a corresponding product display module.

22. A display fixture according to claim 21, further comprising a plurality of planar indicia, one of said indicia being positioned proximal and at a greater elevation to each one of said rods of said product display modules, each of said indicia being at an elevation substantially equivalent to the elevation of an adjacent of said indicia, all of said indicia being substantially coplanar.

* * * * *